US005584472A

United States Patent [19]

Hidding et al.

[11] Patent Number: 5,584,472

[45] Date of Patent: Dec. 17, 1996

[54] METHOD AND APPARATUS FOR CONTROLLING A BUFFER STOCK OF FLAT OBJECTS

[75] Inventors: Gerhard Hidding, Heerenveen; Bertus K. Edens, Drachten, both of Netherlands

[73] Assignee: Hadewe B.V., Drachten, Netherlands

[21] Appl. No.: 417,672

[22] Filed: Apr. 6, 1995

[30] Foreign Application Priority Data

Apr. 6, 1994 [NL] Netherlands ..... 9400541

[51] Int. Cl.[6] ..... B65H 5/22

[52] U.S. Cl. ..... 271/3.06; 271/3.03; 271/3.13; 271/3.05; 271/263; 271/265.04

[58] Field of Search ..... 271/3.01, 3.03, 271/3.05, 3.06, 3.13, 263, 262, 265.04; 209/603

[56] References Cited

U.S. PATENT DOCUMENTS

| | | | |
|---|---|---|---|
| 3,791,392 | 2/1974 | Hanson | 271/3.06 |
| 4,986,423 | 1/1991 | Takeda | 271/3.01 |
| 5,027,587 | 7/1991 | Ramsey . | |

FOREIGN PATENT DOCUMENTS

| | | | |
|---|---|---|---|
| 392867 | 10/1990 | European Pat. Off. . | |
| 3424665 | 2/1986 | Germany | 271/262 |
| 0048346 | 5/1981 | Japan | 271/262 |
| 5-147768 | 6/1993 | Japan | 271/262 |

OTHER PUBLICATIONS

Abstract of JP 6,056,311, Patent Abstracts of Japan, vol. 18, No. 294, Jun. 6, 1994.

*Primary Examiner*—H. Grant Skaggs
*Attorney, Agent, or Firm*—Burns, Doane, Swecker & Mathis, L.L.P.

[57] ABSTRACT

For temporarily storing sheets, envelopes and the like, the objects are received one by one in a buffer apparatus and delivered one by one from that apparatus. For each object, a code associated with that object is determined, which code is stored in accordance with the order of receipt of the objects. Each object that is discharged is scanned and the scanning result is compared with a code that on the basis of order information is supposed to be associated with that object. If a particular minimum extent of agreement between the compared data is found, a normal operating status is adhered to. If less than the particular extent of agreement between the compared data is found, an error message status is selected. There is also described a buffer apparatus for temporarily storing the objects. Different objects can indiscriminately be processed in an irregular order and checked for separation.

13 Claims, 3 Drawing Sheets

METHOD AND APPARATUS FOR CONTROLLING A BUFFER STOCK OF FLAT OBJECTS

FIELD AND BACKGROUND OF THE INVENTION

This invention relates to a method for temporarily storing flat objects in the form of sheets, envelopes or compositions therefrom.

For producing a mail item different operations can be carried out in line. It is for instance known to collect documents and appendices such as preprinted sheets and return envelopes, to fold them before or after collecting and finally to pack the thus obtained compositions in envelopes, in a mechanized and in-line manner. The stations for performing these operations in a mechanized manner have been especially designed for this purpose and for mutual cooperation, allowing the flow of mail items in the making to be controlled by a central control unit or by intercommunication between the stations, and accumulations of successive components intended for different mail items to be prevented.

However, if it is desired to print the documents in line, a printer should be disposed upstream of the stations that have been attuned to each other. Printers are apparatuses having a specific technology. For this reason, it is generally more attractive to utilize commercially available printers for this than to develop or adapt a printer especially for that purpose. Moreover, for many users, the possibility of using a standard printer offers the advantage that a printer which is already present can be used in combination with the apparatus for composing mail items for in-line printing and finishing printed documents to become mail items. Normally, however, printers for general use are not designed for cooperation with apparatuses disposed downstream thereof, as a consequence of which provisions are required for causing the output of the printer to connect with the input of the downstream apparatus (for instance an apparatus for composing mail items).

SUMMARY OF THE INVENTION

The object of the invention is to provide a method with which the output of a station delivering flat objects, such as a printer, and the input of an apparatus, disposed downstream and in line therewith, for processing those delivered objects, can be adjusted to each other in a reliable and user-friendly manner.

In accordance with the present invention, this object is realized with a method for temporarily storing flat objects such as sheets, envelopes or compositions therefrom.

The objects are received one by one, for each received object a code is determined that is associated with that object, and reference data corresponding to that code (optionally identical to that code) are stored in accordance with the order of receipt of the objects.

After a short or longer time, received objects are discharged one by one in an order dependent on the order of receipt of those objects.

Each object that is discharged is scanned. Registered measuring values are processed into a scanning result obtained upon the scanning of the object. On the basis of the order of receipt of the objects, the reference data associated with the discharged object are read and the scanning result obtained upon the scanning of the object is compared with that one of the codes that is associated with or is represented by the reference data read.

Finally, if at least a predetermined extent of agreement between the code and the scanning result is found, a first operating status is selected or, if less than the predetermined extent of agreement between the code and the scanning result is found, a different operating status is selected.

Because the received objects are temporarily stored, the output of objects can temporarily be greater and subsequently smaller than the input of objects in the apparatus disposed downstream of the object-delivering apparatus.

In the case of for instance printers, the problem that a double or multiple object is delivered does not infrequently occur, because objects are not separated from one another when delivered from a storage holder of the printer. This double object consists of a printed first object and an unprinted second object, the objects lying completely or partly on top of each other.

It may also occur that double objects are delivered upon the delivery of objects after the temporary storage. These objects may have the same composition as the supplied double objects or may consist of two printed, separately supplied and received objects.

If a double object is delivered by the printer and this object, after having been temporarily stored, is delivered in the form of two separate single objects, or if two separately supplied objects are delivered as a double object, errors in the processing of those and subsequently objects may be caused in various ways.

For instance, if the objects are in each case collected in pairs for collective dispatch as first and second sheets of the same mail item, an unprinted sheet delivered by the printer as part of a double sheet will be processed as first or second sheet of a mail item, as a result of which the second sheet of that mail item will be processed as first sheet of a next mail item. Hence, if no further irregularities occur, all following mail items will further consist of the second sheet of the preceding mail item and the first sheet. As a consequence, a large number of addressees will receive a sheet intended for another addressee. A comparable effect may also occur if after the temporary storage separately supplied sheets are delivered as a double sheet. If different, predetermined appendices are to be selectively added to successive single objects or objects collected to form sets, the above-outlined failures may cause a large number of appendices to be added to the wrong printed objects.

It will be understood that these effects are particularly undesirable, especially if the printed objects and/or the appendices contain more or less confidential information specifically intended for the addressee.

It is per se known to guard whether double sheets are supplied by scanning whether the thickness of a particular object exceeds a particular limiting value. However, this limiting value should be set in accordance with the thickness of the objects to be processed. This setting is in the first place laborious and hence not user-friendly. In the second place, a fixed setting is not suitable for guarding objects of different thicknesses passing in a random order. This is for instance necessary if a printer has several storage holders, each storage holder containing sheets of a different thickness, and sheets supplied from different storage holders are printed without a fixed order.

However, because, in accordance with the invention, for each received object a code is determined that is associated with that object and reference data associated with this code are stored according to the order of receipt of the objects, upon delivery of each object it is known on the basis of the reference data which code is associated therewith. Hence, for each object that is discharged, the scanning results found when the received objects are discharged and scanned one by one—which is generally carried out simultaneously with the receiving, one by one, of further objects—can be compared with a reference value associated with or represented by reference data which are read from the memory and which, on the basis of the sequence information, should be associated with that object.

By selecting, in each case after the scanning of each object discharged, a first operating status if at least a predetermined extent of agreement has been found between the compared scanning results and the reference data read from the memory, or selecting a different operating status if less than that predetermined extent of agreement has been found, the downstream apparatus for composing mail items can for instance be brought into a stand-by position (the other operating status) as soon as scanning results of an object deviate too much from the reference data read from the memory that would have to be associated with that object. The other operating status could also involve further measures in connection with the message of a deviation in respect of the discharged object, such as the discharge of the object that was last detected to a discharge position and/or issuing an alarm signal. The first operating status will generally consist of the further operation, in a normal manner, of the upstream discharge station, the downstream apparatus and the buffer apparatus.

Instead of or in addition to the printing of objects, other operations can also be carried out upstream of the buffer apparatus, such as special folding treatments, attaching sheets to one another or writing data in a strip of magnetizable material or in a chip integrated in the flat object.

The invention can also be embodied in a buffer apparatus according to claim 9, which is essentially adapted to carry out the method according to the invention.

Hereinafter, the invention will be further explained with reference to some practical elaborations and exemplary embodiments.

MODES FOR CARRYING OUT THE INVENTION

Figure 1:
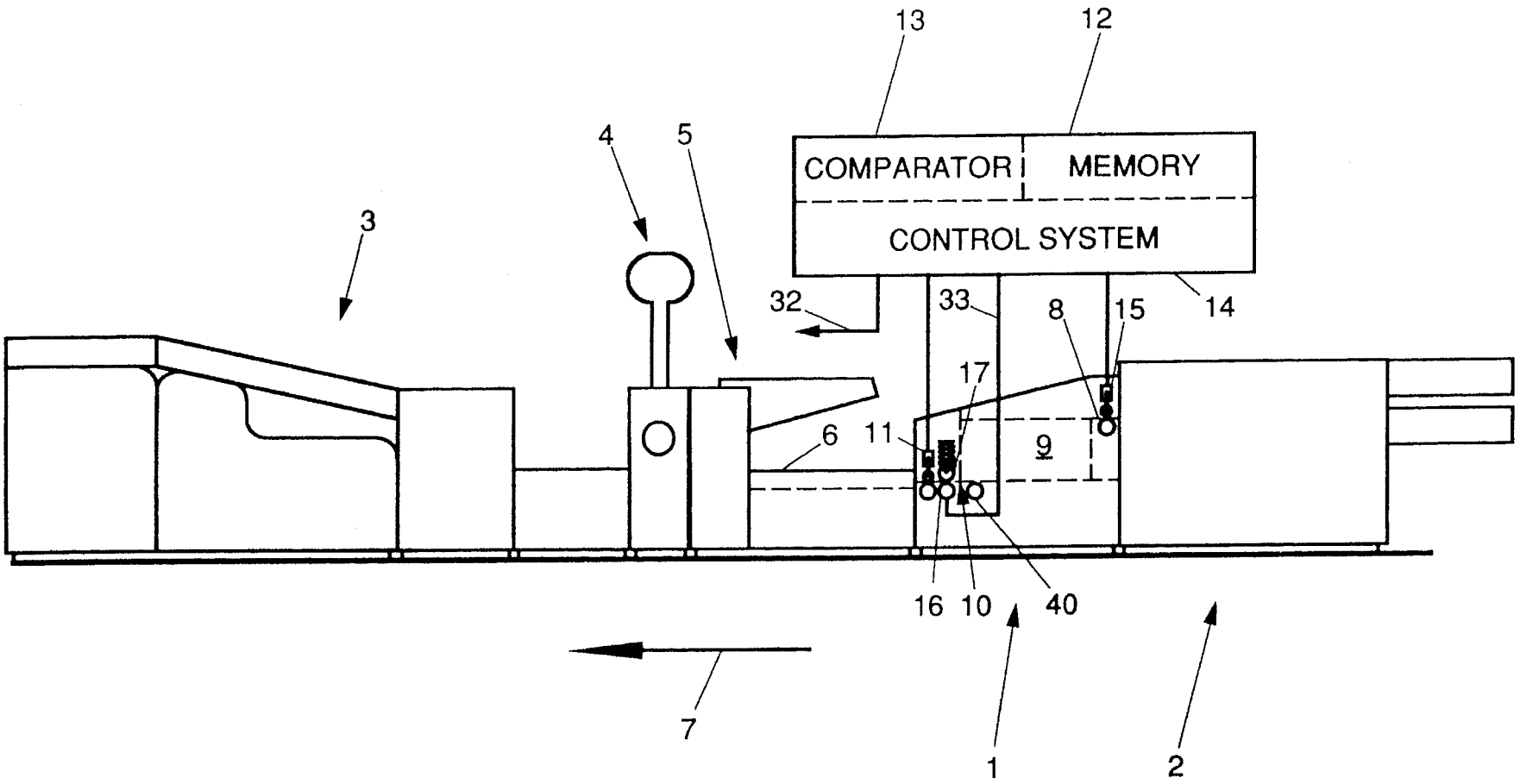
FIG. 1 is a schematic side elevation of a buffer apparatus according to the invention in disposed condition between a printer and an apparatus for composing mail items.
Figure 2:
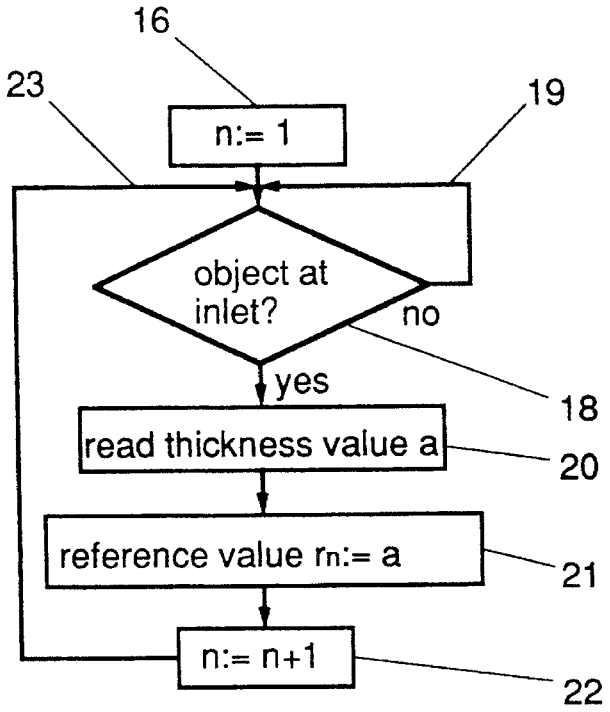
FIG. 2 is a flow diagram of a part of the method according to the invention.
Figure 3:
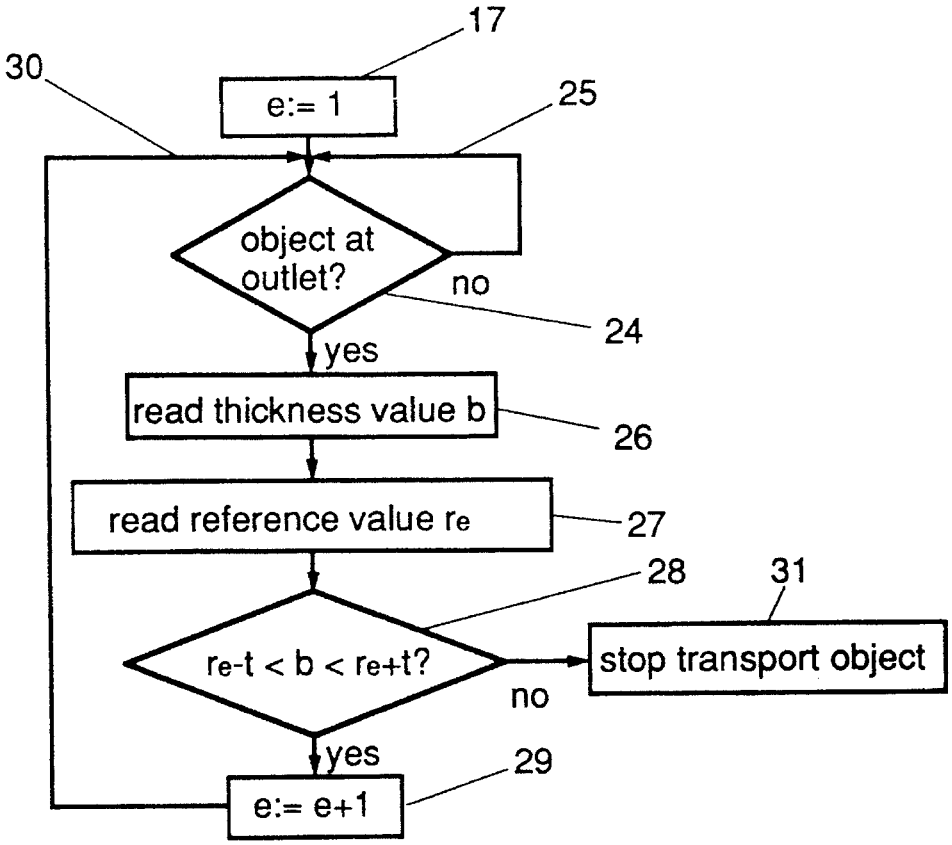
FIG. 3 is a flow diagram of a further part of the method according to the invention.

FIG. 1 shows an embodiment of a buffer apparatus according to the invention that is presently most preferred. The flow diagrams in FIGS. 2 and 3 represent subroutines for carrying out the method according to the invention that are presently most preferred.

FIG. 1 shows a buffer apparatus 1 according to the invention, arranged upstream of an apparatus for composing mail items and downstream of a printer 2. The main direction in which components of the mail items to be composed are conveyed in operation is designated by an arrow 7. The apparatus for composing mail items shown consists of an inserter station 3, a folding station 4 and a feeder station 5. The folding station 4 and the feeder station 5 are disposed on a conveyor 6. The portion of the conveyor 6 upstream of the feeder station 5 is adapted to stackwise collect the objects, such as sheets and envelopes, that are delivered by the buffer apparatus 1. As stations 3, 4, 5 and conveyor 6, commercially available components of the Neopost "System 7" product line can be employed.

The buffer apparatus 1 is intended for receiving, one by one, the printed objects delivered by the printer 2, temporarily storing the received objects if they cannot be fed to the apparatus for composing mail items right away, and feeding flat objects one by one to the apparatus for composing mail items as soon as this apparatus is ready to receive now objects.

The buffer apparatus 1 comprises a feed track 8 for receiving the objects one by one, a structure for supporting the received objects, which structure bounds a buffer space 9 for storing the received objects, and a discharge track 10 having means for discharging, one by one, objects stored in the buffer space 9. The means for discharging, one by one, objects from the buffer space 9 are constructed in accordance with the bottom-feed principle for delivering sheets one by one from the bottom. For this purpose, these means comprise a feed roller 40, a conveying roller 16 and a separating roller 17. Various examples of such separating systems are known, inter alia in the field of mechanized mail composition.

Provided along the discharge track is a detector 11 for detecting for each passing object a value of a quantity depending on the thickness thereof. For the detector 11 shown, the quantity referred to is the displacement of a suspension element connected with a scanning roller. Alternatively, however, other quantities can be measured as well, such as the capacity of a capacitor formed by two capacitor plates arranged on both sides of the discharge track and an object (whose thickness is to be scanned) between those plates, the intensity of the light penetrating an object, or the weight of an object.

The buffer apparatus 1 further comprises a memory for receiving and storing signals which each represent a reference value associated with one of the objects. This memory is schematically shown as a memory block 12 located outside the apparatus. Comparing means for receiving and comparing signals coming from the memory 12 and from the detector 11, which comparing means are coupled to the memory 12 and the detector 11, are schematically shown as a comparator block 13. Control means coupled to the detector 11, to the memory 12 and to the comparing means 13 are schematically shown as a control system block 14. These control means 14 are adapted to supply, in accordance with the discharge of objects, reference values stored in the memory 12 and associated with those objects to the comparing means 13, to select a first operating status if more than a particular value of agreement between values added thereto has been found by the comparing means 13, and to select a different, second operating status if less than a particular value of agreement between values added thereto has been found by the comparing means 13.

To the memory 12, the comparing means 13 and the control means 14, it applies that they are shown as blocks located outside the housing of the buffer apparatus only for clarity's sake, but in practice they are of course preferably accommodated within the housing of the buffer apparatus 1. In particular the memory 12, the comparator 13 and the control system 14 are preferably integrated into a single, suitably programmed processor assembly.

Provided along the feed track 8 is a further detector 15 for detecting the value of a quantity depending on the thickness of a supplied object. According to the exemplary embodiment shown, this detector is identical to the detector 11 provided along the discharge track 10. The memory 12 is coupled to the detector 15 provided along the feed track 8, for storing values detected by that detector 15. For easy reference, the detector 11 provided along the discharge track 10 will hereinafter be referred to as the discharge detector 11 and the detector 15 provided along the feed track 8 will hereinafter be referred to as the feed detector 15.

To enable communication with the control means of the apparatus for composing mail items, inter alia for controlling the delivery of objects from the buffer apparatus, the control system is coupled to the control means of the apparatus for composing mail items. In the drawing, this connection is schematically designated by the arrow 32. For controlling the delivery of documents, the control system is connected with means for operating the drive of the conveying roller 16. This connection is represented by the connection line 33.

In the following description of the operation of the buffer apparatus according to the embodiment shown, it is presumed that the processed flat objects are separate sheets, although they could be other objects as well, such as envelopes, plastic cards of the type that is for instance used as credit card or compositions from different flat parts, such as carriers having invitation cards, discount coupons, etc. attached thereto. The operation is described with reference to FIGS. 3 and 4. These Figures show the flow diagrams of routines of the method according to the example described hereinafter. FIG. 2 shows the steps relating to the receipt of sheets and FIG. 3 shows the steps relating to the delivery of sheets.

After the buffer apparatus has been set in operation or reset, the counters n and e for counting incoming and outgoing sheets respectively are set at 1 (steps 16 and 17 respectively) and it is checked whether a sheet is present in the area of the feed track 8, which is shown as step 18. This step can for instance be carried out by testing whether a thickness value in excess of a particular limiting value is observed by the feed detector 15, or by testing whether the intensity of light received by a light-sensitive sensor drops below a particular limiting value. As long as no sheet is detected at the location of the inlet, step 18 is repeated as is shown by means of the connecting arrow 19.

If the printer 2 functions in the intended manner, sheets are delivered one by one. These sheets are supplied to the buffer apparatus 1 via the feed track 8. The presence of a sheet at the location of the inlet causes the result of the test 18 to change, as a result of which the following step is proceeded to; determining a code that is dependent on the thickness of the received sheet. In the present example, this code depends on the value detected by the feed detector 15 upon the scanning of the object. This step is shown as function block 20.

After the thickness value a has been determined, reference data are stored in accordance with this code and the order of receipt of the sheets. In the method according to the above-described example, this step, represented by block 21, consist in storing the thickness value a, associated with the sheet just scanned, in association with the actual value of the counter n, forming the serial number of entry of the sheet, as reference date $r_n$. Subsequently, the actual value of the counter n is increased (step 22). The routine involved in receiving sheets has now been completed, and the status wherein it is regularly checked whether a sheet is present at the location of the inlet is returned to. This return is represented by connecting arrow 23. As soon as the thickness value of a sheet has been scanned, the scanned sheet can be conveyed to the buffer space 9. Optionally, a delay can be incorporated into the routine in order to avoid determination of the thickness value of the same sheet more than once. For this purpose, however, the routine can also be designed so that it should first at least once be established that no sheet is present at the location of the inlet, before the determination of a next thickness value a is proceeded to.

When a next sheet can be received by the conveying track 6, the separation and discharge of one of the received sheets is proceeded to. For this purpose, the feed roller 40 is driven, whereby a subjacent sheet is fed via the conveying track 10 to the conveying roller 16 and separating roller 17 provided opposite one another on both sides of the conveying track. If a sheet is carried along with the subjacent sheet, it will, if the separating means function in the intended manner, be retained by the separating roller 17, so as to pass only the subjacent sheet along the discharge detector 11 and to the conveyor 6.

It is regularly tested whether a sheet is present in the discharge track 10 in the area of the detector 11. This is represented by the diamond 24 in FIG. 3. As long as no sheet is present, the test is repeated, as is represented by connecting arrow 25.

When a sheet that is discharged is indeed present in the discharge track 10, the test of the presence of a sheet at the location of the outlet will yield a positive result. For each sheet that is discharged, the thickness is scanned by the discharge detector, which results in a signal being provided representing a value of the scanned thickness. In response to the observed presence of a sheet in the discharge track 10, the value b observed by the discharge detector 11 is read, as is represented by block 26.

The reference data stored in association with the actual value of the counter e, representing the serial number of discharge of the discharged sheet, are also read (block 27). In the present case, these reference data $r_e$ represent the thickness value associated with the serial number e.

Subsequently, the value scanned by the discharge detector 11 is compared with the reference value read, associated with the actual serial number. This is represented by diamond 28. According to the present example, it is tested whether the thickness value b detected by the discharge detector 11 lies within a margin plus or minus t around the stored reference value $R_e$ associated with the actual serial number e. The value of t can be fixed, for instance corresponding to half the thickness of a thinnest sheet processable, or variable and for instance correspond to a quarter of the value of $r_e$ or b.

If the thickness value b detected by the discharge detector 11 lies within a margin plus or minus t around the stored reference value $r_e$ associated with the actual serial number e, a first operating status is selected, essentially consisting in the apparatus further operating in a normal manner and the scanned sheet being further discharged to the conveyor 6. The counter e is increased (block 29) and the stage in which the presence of a sheet in the discharge track 10 is regularly tested is returned to (connecting arrow 30).

If the thickness value b detected by the discharge detector 11 is not within a margin plus or minus t around the stored reference value $r_e$ associated with the actual serial number e, a second operating status is selected, wherein the transport of the sheet is ceased (block 31). If desired, an alarm signal can be provided as well, but in general, personnel operating the system will soon notice that no sheets are delivered by the buffer apparatus 1. Preferably, it is indicated in a display that for the sheet in the discharge track 10 insufficient agreement has been determined between the thickness values found upon the inlet detection and the outlet detection.

Because for each received sheet a code is determined that depends on the thickness of that sheet, and reference data in agreement with this code are stored in accordance with the order of receipt of the sheets, the thickness area in which the thickness of a sheet should lie is known for each sheet upon delivery, on the basis of the reference data. Hence, when the received sheets are discharged one by one—which is generally performed simultaneously with the receipt, one by one, of further objects—the detected thickness value can for each sheet that is discharged be compared with a reference thickness value associated with that sheet.

By selecting a first operating status if at least a predetermined extent of agreement between the compared values is found, or selecting a second operating status if less than the predetermined extent of agreement between the compared values is found, a sheet can be retained in the buffer apparatus, if the detected thickness of that sheet deviates too much from the thickness which it should have according to the reference data. The fact the difference between the values detected by the feed detector 15 and the discharge detector 11 is greater than it should be according to the intended extent of agreement, shows that a double or multiple sheet has been delivered either by the printer 2 or by the separating means of the buffer apparatus 1, while the components of the multiple sheet have been separated or have at least been separated differently by the separating means of the buffer apparatus 1 or by the printer 2 respectively. If the system continued its operation normally, the serial numbers of discharged sheets would no longer correspond to the serial numbers allocated to those sheets when supplied, as a consequence of which each set would include sheets intended for a set that precedes it or follows it. However, because a sheet whose thickness value insufficiently corresponds to the reference value is not discharged to the conveyor 6, this is prevented. Personnel operating the system is then given an opportunity to remove the wrongly processed sheets from the system, in order to collect, after a restart, sheets again to form sets of the intended composition.

Moreover, in order to resume the processing of sheets after an error message in the intended manner, all sheets following the wrongly processed sheets can be removed from the buffer apparatus 1 and the printer 2 and printed again after restart. In that case, it is preferred if in the second operating condition, i.e. after a message of insufficiently corresponding thickness, the printer be stopped as well, which minimizes the number of superfluously printed sheets. Instead, it is also possible to adjust the counter e in accordance with the number of removed documents and the location where a double of multiple sheet was delivered. Accordingly, the removed sheets can for instance be manually processed into mail items.

The other operating status can also comprise an automatic recovery procedure, wherein, if it is detected that a multiple sheet has been received and discharged as single sheets, the counter e is retained in accordance with the difference between the numbers of separately received and discharged objects. This difference can be determined from the difference in thickness between the supplied and the discharged objects. In that case, it is accepted that a mail item may contain an empty sheet. If it is desired that a multiple sheet is discharged, while all sheets included therein are intended for the same set, the counter e can be increased in accordance with the number of additional sheets carried along in the multiple sheet according to the difference in thickness measured.

Because the determination of the codes depending on the thickness of each sheet is performed by passing the sheets along a feed detector 15 and scanning, by means of that detector 15, values of a quantity depending on the thickness of the sheets, a new reference value is automatically determined for each new object, as a result of which no separate setting phase is required for inputting those values, the risk of drift of the reference value is very small and sheets of different thicknesses, not priorly known, at least within a specific range, can indiscriminately be processed in random order. A further advantage is that the response time between delivery of a multiple sheet by the printer 2 and the transition to the second operating condition is relatively short. For a multiple sheet, a reference value corresponding to the thickness thereof is stored. If the multiple sheet is separated differently when delivered, for instance only in separate, individual sheets, the value detected by the discharge detector and compared with the reference value associated with the serial number of the multiple sheet will indicate a thickness value that is substantially less than the reference value, as a result of which the second operating condition is directly changed to and the delivery of documents from the buffer apparatus 1 is interrupted until further order.

If the components of the multiple sheet are fixedly attached to one another so that the multiple sheet is discharged in the same composition as the composition in which it was supplied, the thickness values detected by the feed detector 15 and the discharge detector 11 will essentially correspond, as a consequence of which no error message due to transition to the second operating condition follows. This behavior of the buffer apparatus 1 is advantageous, because in this case, the incorrect separation does not cause printed sheets to be incorporated into sets other than the sets for which they are intended. The result is merely that the set containing the multiple document contains one or more unprinted sheets.

Instead of or in addition to the printing of objects, upstream of the apparatus for composing mail items other operations can be performed as well, such as special folding operations, attaching sheets to one another or writing data, for instance in a strip of magnetizable material or in a chip integrated into the flat object.

Figure 4:
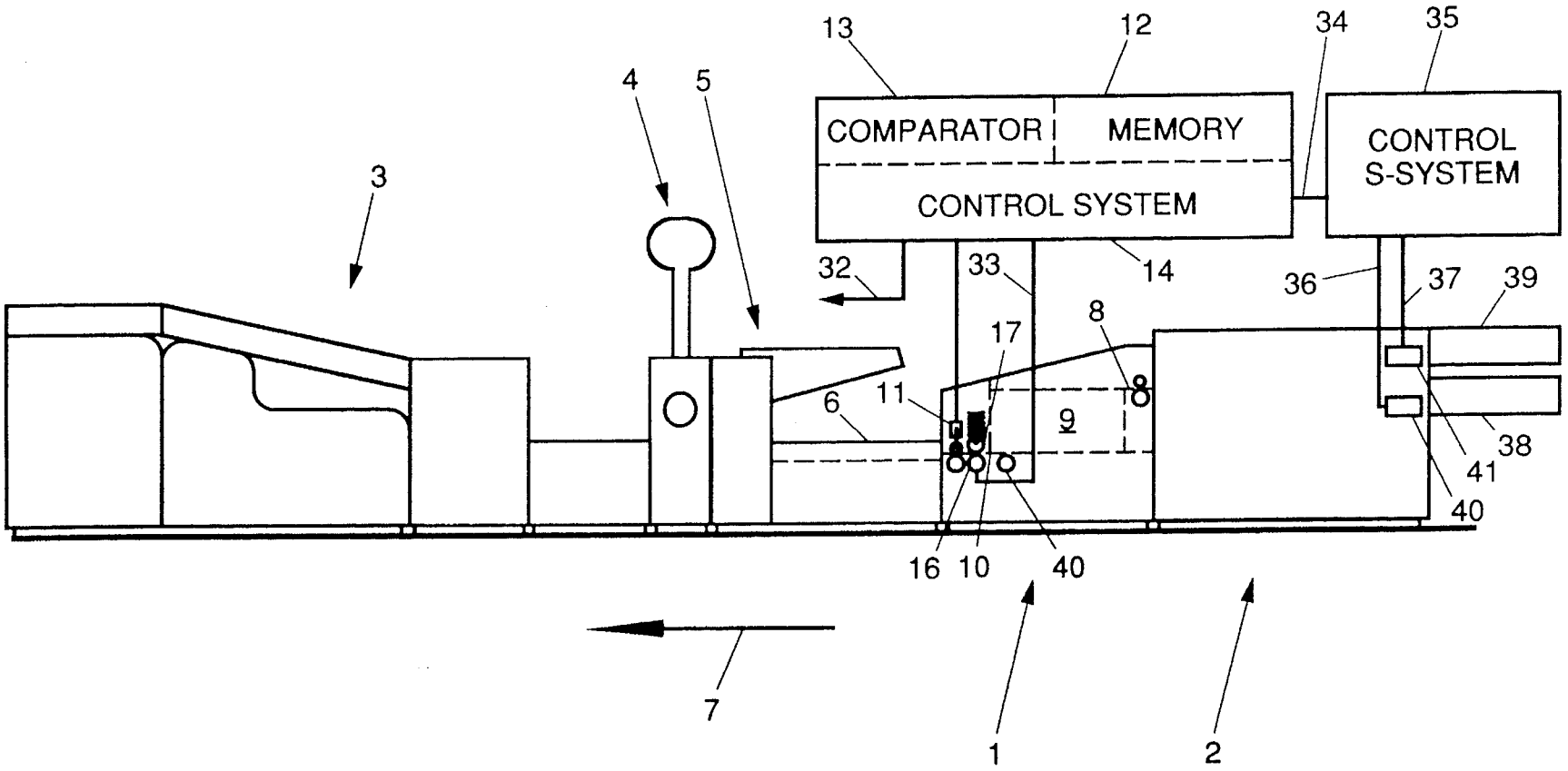
FIG. 4 is a schematic side elevation according to FIG. 1, however with an alternative embodiment of the buffer apparatus according to the invention.

FIG. 4 shows a control system 35 of the printer 2, connected, via connections 36, 37, with the operating elements 41, 42 of separating and conveying means associated with one of two storage trays 38, 39.

The buffer apparatus 1 shown in FIG. 4 comprises means for inputting, in association with each received object, a code associated with the object. These means are designed as a connection 34 with the control system 35 of the printer 2.

The determination of the codes that are dependent on the thickness of each object is carried out by inputting, from the control system, a code associated with the objects, indicating from which of the storage trays 38, 39 the object is supplied. In the memory 12 of the buffer apparatus it is stored which thickness value is associated with each of the storage tray codes, enabling determination of the reference value for each object supplied to the buffer apparatus 1 via the serial number and the associated storage tray code, with which reference value the thickness value detected by the discharge detector should be compared when the object having the same serial number is discharged.

The discharge detector 11 is connected with the memory 12 for storing the values, detected by that detector 11, of a quantity depending on the thickness of the objects in association with codes which each represent a type of object.

Consequently, the inputting of the thickness values associated with the storage tray codes can be effected by placing, during a setting phase, samples of the objects to be processed in the buffer space 9, passing them one by one along the detector 11, detecting for each sample a value of a quantity depending on the thickness of that object and storing it in the memory 12 in association with a code representing that type of object or the storage tray 38 or 39 wherein that type of object is placed. The setting phase is followed by the operating phase wherein the determination of the codes depending on the thickness of each received object is carried out by reading from the memory 12 the code associated with that object.

Another possibility for inputting reference values or reference areas associated with objects that are supplied from a particular source is to store thickness values for particular types of objects in a memory, for instance the memory 12, in association with a type code. By indicating which type code is associated with the objects that are placed in a particular holder, it can be determined with which reference value or with which reference area the thickness value should be compared, which is obtained by scanning an object discharged from the buffer space 9 and originally coming from that holder.

In spite of the fact that the use of the apparatus according to FIG. 4 does not involve scanning of the thickness of the supplied objects upon receipt of the objects, multiple objects delivered by the printer 2 can be detected all the same, even if they are discharged individually upon discharge from the buffer space 9. Because objects of different thicknesses from different storage trays have been supplied in a known order, the delivery of a multiple object by the printer 2 and the individual discharge of these objects from the buffer space 9 will have as a result that at least during the scanning of following objects at the moment when an object from a different storage tray should be discharged, another object is discharged from the preceding storage tray. Consequently, the thickness scanned will exhibit less than the required extent of agreement with the reference value. In response thereto, the buffer apparatus 1 will change into the second operating condition which, as described hereinabove, implies an error message. If the objects from the two storage trays have such an equal thickness, agreement will still be found, even though instead of an object from one storage tray, an object from the other storage tray is discharged. In that case, multiple objects delivered by the printer 2 cannot be detected without detection of objects when received by the buffer apparatus 1.

As appears from above, the codes associated with an object supplied to the buffer apparatus 1 can each refer to a thickness value stored in the memory 12 and are read for determining an associated thickness value. This thickness value is used as reference value and is compared with the value, scanned upon the discharge of the object having the same serial number, of a quantity depending on the thickness of the discharged object. As appeared from the example, wherein the reference value associated with an object is determined by scanning the thickness of that object, the codes can, however, also represent thickness values directly.

In the above-described examples, the stored objects are in each case delivered in accordance with the first-in-first-out principle. This offers the advantage that when the printer 2 and the buffer apparatus 1 operate properly, the order of entry of the objects is identical to the order of discharge of the objects, so that it can readily be controlled and an arrangement according to postal code, if any, is maintained. However, as desired, it is also possible to discharge the objects according to the first-in-last-out principle or in random order according to the two principles, if the numbers to be allocated to the objects to be discharged are selected accordingly, so as to maintain for each object correspondence with the serial number of receipt allocated thereto.

Within the purview of the above-described invention, many other examples other than those described hereinabove have been brought within the reach of a skilled person. For instance, the codes associated with each object and the scanning results that are in each case compared with one of the codes may also represent, instead of the thickness, other properties of the objects, such as brightness patterns (optionally in the form of special optical characters), lengths, dielectric properties, magnetic properties, weights and transparency.

I claim:

1. A method for temporarily storing flat objects in the form of sheets, envelopes or compositions therefrom, comprising the following operations:

receiving objects one by one;

for each received object: determining a code associated with that object, storing reference data in accordance with said code and storing the object, the reference data being stored in accordance with the order of receipt of the objects;

discharging, one by one, at least a number of the received objects in an order determined by the order of receipt; and for each object that is discharged: scanning the object, processing measuring values into a scanning result obtained upon scanning, reading the stored reference data associated with the object discharged in accordance with the order of receipt, comparing said scanning result with one of said codes associated with or represented by the reference data read, and selecting a first operating status if at least a predetermined extent of agreement between the code and the scanning result is found or selecting a different operating status if less than the predetermined extent of agreement between the code and the scanning result is found.

2. A method according to claim 1, wherein the code and the scanning result depend on the thickness of the objects and the scanning of the objects that are discharged comprises the scanning of the thickness of those objects.

3. A method according to claim 1, wherein the determination of codes associated with each received object is carried out by scanning the objects upon receipt.

4. A method according to claim 1, wherein the determination of codes associated with each received object is carried out by inputting, in each case, a code associated with the received object.

5. A method according to claim 1, comprising:

a setting phase, wherein for each type of object to be processed a code is obtained by scanning the objects and stored in a memory as a code representing that type; and an operating phase wherein the determination of the codes associated with the successive objects is carried out by reading from the memory, in each case, a code associated with the relevant type of object.

6. A method according to claim 1, wherein the codes represent thickness values.

7. A method according to claim 1, wherein the codes refer to thickness values stored in a memory and are read for selecting a thickness value associated with a particular code, said thickness value being compared with the scanning result that forms the detected value of a quantity depending on the thickness of the object associated with the code.

8. A method according to claim 1, wherein the stored objects are delivered according to the first-in-first-out principle.

9. A buffer apparatus for receiving one by one, temporarily storing and delivering one by one flat objects in the form of sheets, envelopes or compositions therefrom, comprising:

a feed track for receiving the objects one by one, a buffer space for storing the received objects, a discharge track having means for discharging objects one by one from the buffer space, a detector, provided along the discharge track, for scanning each passing object and for processing measuring values obtained upon scanning into a scanning result, a memory for receiving and storing signals that each represent or refer to reference data associated with one of the objects, processor means coupled to the memory and the detector for receiving and comparing signals coming from the memory and from the detector, and control means coupled to the detector, the memory and the processor means, said control means being adapted to supply, in correspondence with the discharge of objects, reference data from the memory to the processor means, which reference data are each associated with one of said objects in accordance with the order of receipt of the objects; to select a first operating status if more than a particular extent of agreement between the reference data and the scanning result is found by the processor means; and to select a different operating status if by the processor means less than a particular extent of agreement between values supplied thereto is found.

10. A buffer apparatus according to claim 9, comprising a detector, provided along the feed track, for scanning each received object.

11. A buffer apparatus according to claim 9, wherein said detector is designed as a thickness gauge.

12. A buffer apparatus according to claim 9, comprising means for inputting in the memory a code associated with the object in association with each received object.

13. A buffer apparatus according to claim 12, comprising a memory, connected with the detector along the discharge track, for storing values detected by said detector of a quantity depending on the thickness of the objects in association with codes that each represent a type of object.

* * * * *